US005329986A

United States Patent [19]

Wu

[11] Patent Number: 5,329,986

[45] Date of Patent: Jul. 19, 1994

[54] AUTOMATIC MOLDING APPARATUS FOR FORMING SAND CASTING MOLDS

[76] Inventor: Tsuen-Ching Wu, 569 Dong-Guang Rd., Taichung, Taiwan

[21] Appl. No.: 8,232

[22] Filed: Jan. 22, 1993

Related U.S. Application Data

[63] Continuation of Ser. No. 763,232, Sep. 20, 1991, abandoned.

[51] Int. Cl.[5] ..... B22C 11/04; B22C 11/10; B22C 15/02

[52] U.S. Cl. ..... 164/181; 164/194; 164/224

[58] Field of Search ..... 164/181, 194, 224

[56] References Cited

U.S. PATENT DOCUMENTS

| | | | |
|---|---|---|---|
| 569,743 | 10/1896 | Bryant | 164/194 |
| 1,134,396 | 4/1915 | McCarte | 164/224 X |
| 1,137,658 | 4/1915 | Oddy | 164/194 |
| 1,707,411 | 4/1929 | Nicholls | 164/194 X |
| 2,317,574 | 4/1943 | Williams | 164/181 |
| 2,856,654 | 10/1958 | Péras | 164/181 |
| 4,114,677 | 9/1978 | Wernli | 164/181 X |

FOREIGN PATENT DOCUMENTS

| | | | |
|---|---|---|---|
| 1-306044 | 12/1989 | Japan | 164/181 |
| 1228961 | 5/1986 | U.S.S.R. | 164/194 |
| 1438967 | 6/1976 | United Kingdom | 164/181 |

*Primary Examiner*—J. Reed Batten, Jr.
*Attorney, Agent, or Firm*—Larson and Taylor

[57] ABSTRACT

An automatic molding apparatus includes a rotatable turntable which has located thereon a plurality of pattern supporting plates. A mold pattern located on at least one of the pattern supporting plates is surrounded by a flask located on the pattern supporting plate and having an open top and bottom. A movable sand adding box communicates with the top of the flask when the flask and the pattern supporting plate are moved to a feeding position beneath the sand adding box. The sand adding box has an open top and bottom to allow sand to pass therethrough and into the flask. A feeding channel beneath a sand supply includes an upper opening for allowing sand from the sand supply to enter the feeding channel. A movable plate allows sand in the feeding channel to enter the sand adding box when the movable plate is moved to an open position. After being filled with sand, the flask and sand adding box are raised to a position where a pressing plate compresses the sand in the flask. After the sand is compressed, the pattern supporting plate and flask are lowered and rotated to a clamping position. The flask and pattern supporting plate are raised again and the flask is clamped. The pattern supporting plate and mold pattern are then lowered while the flask is held in position to form a mold cavity in the shape of the mold pattern.

2 Claims, 5 Drawing Sheets

AUTOMATIC MOLDING APPARATUS FOR FORMING SAND CASTING MOLDS

This application is a continuation of application Ser. No. 07/7653,232 filed Sep. 20, 1991 and now abandoned.

BACKGROUND OF THE INVENTION

The present invention relates to a sand casting mold, and more particularly to an automatic molding apparatus for a sand casting mold cavity (pool).

Casting is a time-honored art of forming molten metal into a particular shape by pouring or pressing into a mold. It involves using a mold pattern, which is made from appropriate materials and has a shape and a size similar to those of a cast piece. The mold pattern is then placed in the flask to form a mold cavity(pool). The molten metal is poured into the mold cavity to form a cast piece of a desired shape, which is removed from the mold, after having cooled off and hardened, by dismantling the sand casting mold in which it is formed.

In general, the first step of casting involves the production of a mold pattern in accordance with the size and the shape of a product intended to be cast. The mold pattern so made is then placed in a flask, into which the mold sand is added. After injection channel has been set up in the flask, the mold pattern, which was previously placed in the flask, is removed so as to form a casting mold cavity inside the flask.

Such conventional casting procedures of the prior art as described above are time consuming. In addition, the quality of cast products can not be easily controlled, because the distribution of the mold sand in the flask has to be done manually. Such manual operation can often result in an uneven distribution of the mold sand in the flask, thereby bringing about the production of a cast piece of poor quality.

SUMMARY OF THE INVENTION

It is therefore the primary objective of the present invention to provide a flask in combination with an automated apparatus for making a casting mold cavity.

The foregoing objective of the present invention will be better understood by studying the following detailed description of the preferred embodiment, in conjunction with the drawings provided herein.

DETAILED DESCRIPTION OF THE PREFERRED EMBODIMENT

Figure 1:
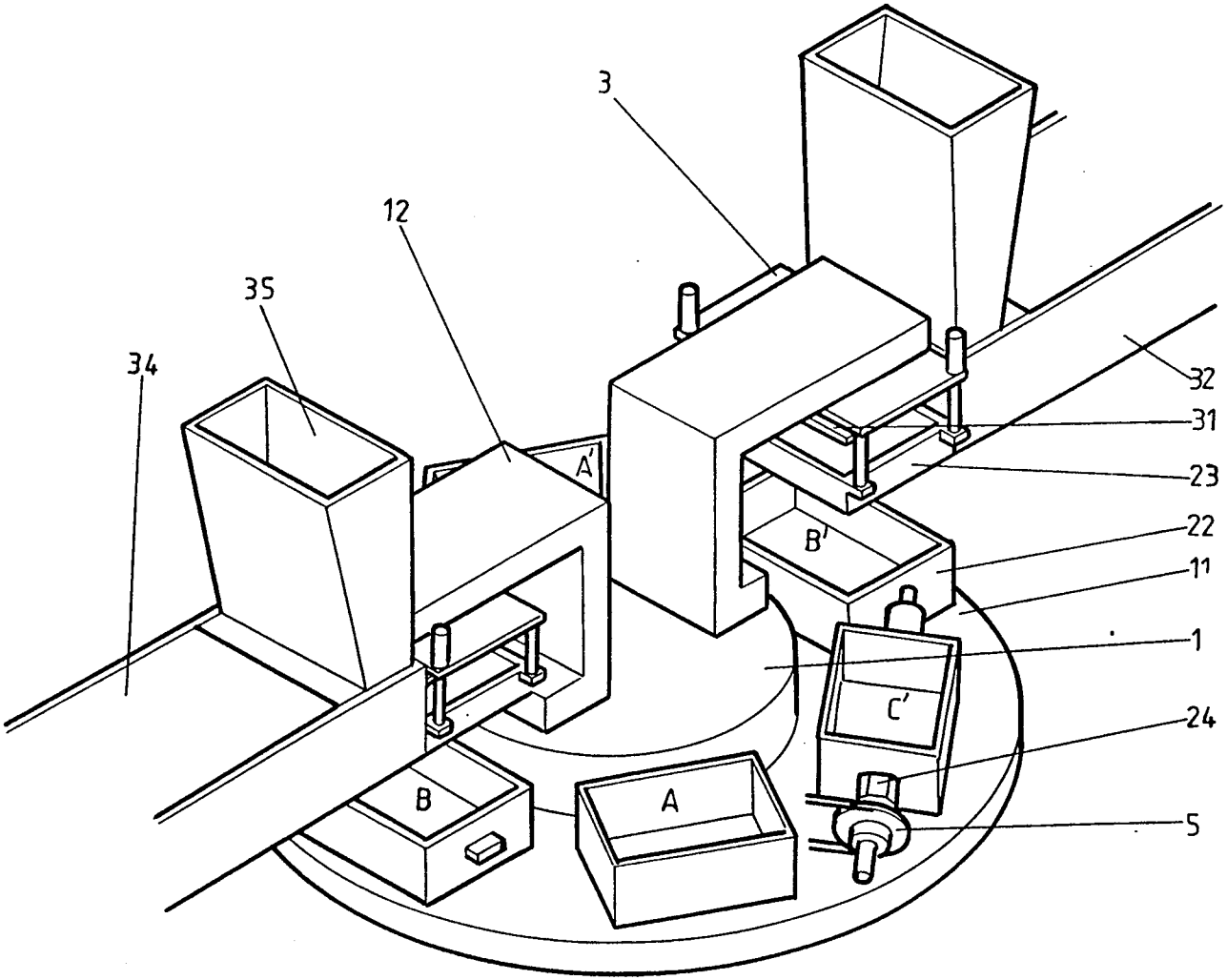
FIG. 1 shows a three-dimensional schematic view of a preferred embodiment of the present invention.
Figure 2:
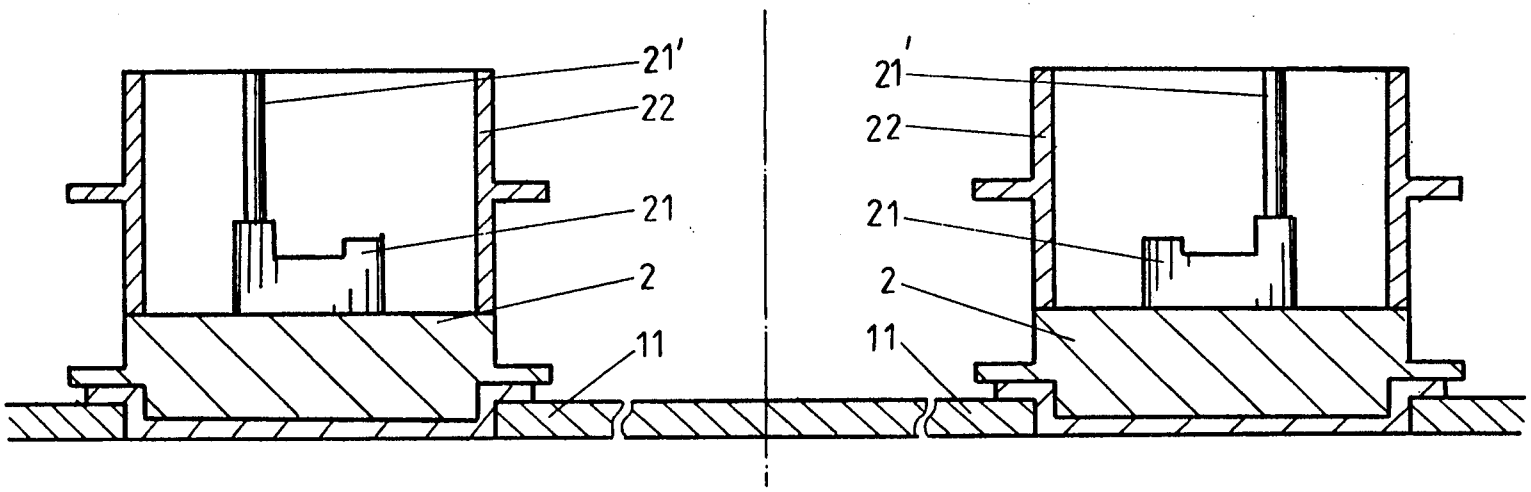
FIG. 2 shows a sectional schematic view of a turntable, two flasks and associated pattern supporting plates of a preferred embodiment of the present invention.
Figure 3:
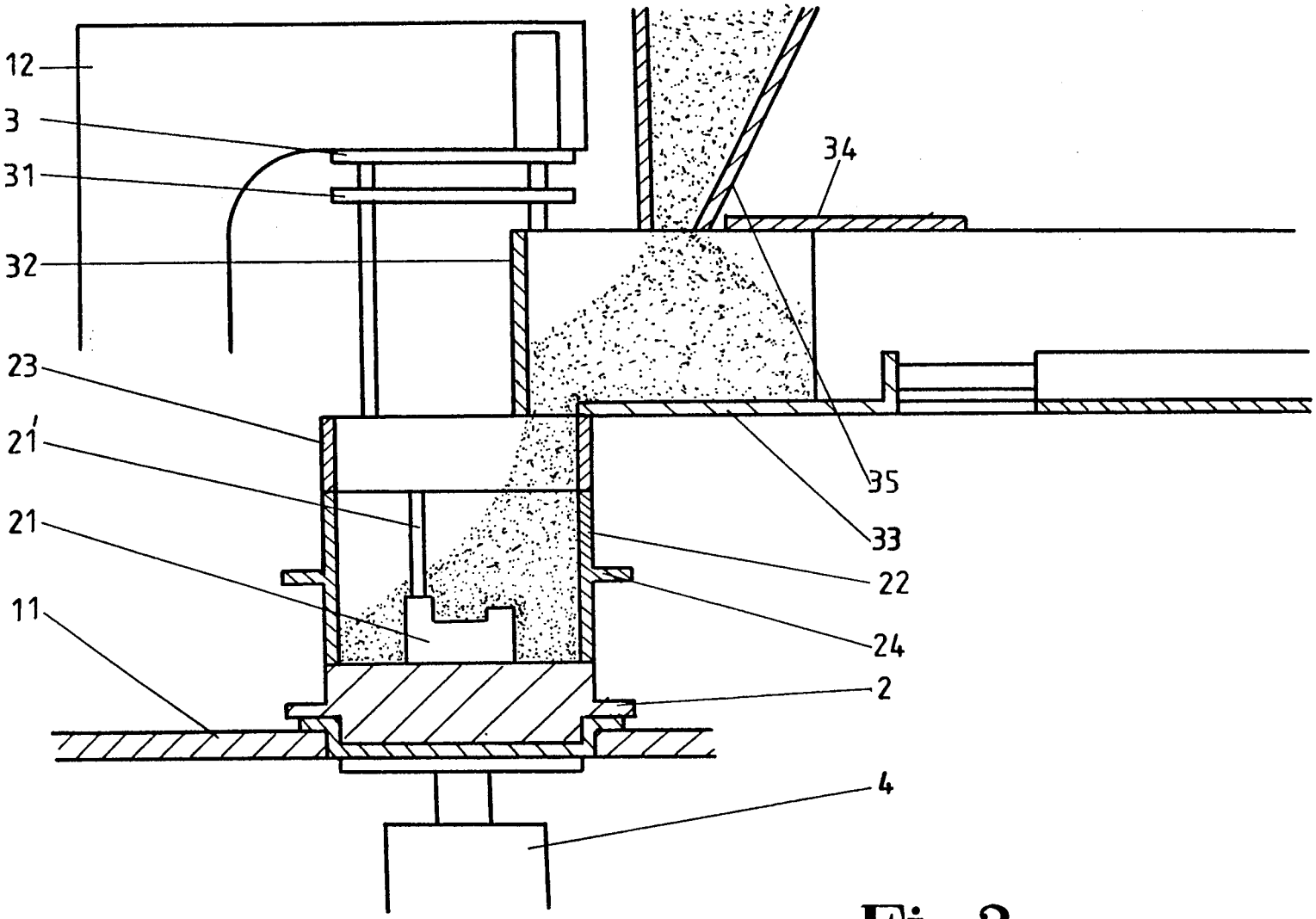
FIG. 3 shows a schematic view of automatic sand feeding according to the present invention.

Referring to all drawings provided herein, the preferred embodiment of the present invention is shown comprising a locking base 1 with a positioning turntable 11 attached thereto. On positioning turntable 11 there are six pattern supporting plates 2 shown in FIG. 2, and associated flasks 22 arranged at equal intervals and positioned correspondingly to one another. Located fixedly on each of the pattern supporting plates 2 is a mold pattern 21. The locking base 1 is further composed of press plate bases 12 disposed respectively at the locations corresponding to positions B and B' for mold patterns 21. An adjusting plate 3 is located under 9 protruding end extending from the upper portion of the press plate base 12. An upper press plate 31 is arranged under the adjusting plate 3 in such a manner that it is capable of being coordinated with a flask 22. A sand adding box 23 is movably disposed under the adjusting plate 3. An automatic sand feeding channel 32 is set up at the outer edge of the positioning turntable 11. A movable plate 33, shown in FIG. 3, is disposed at the bottom portion of the sand feeding channel 32 while the sand stopping plate 34 and the sand storage barrel 35 are disposed respectively over the sand feeding channel 32 in such a way that they can be coordinated with the movable plate 33. An oil-pressured sustaining shaft 4, shown in FIG. 3 is arranged under the pattern supporting plates 2 and the turntable 11. A clamp seat 5 is arranged at the end portion of the handle 24 of the flask 22 and is capable of being driven by the motor 51 shown in FIG. 5.

Once again referring to FIG. 2, a pouring spout 21' is shown over mold pattern positioned in areas A and A'. As mentioned previously, each mold pattern 21 is fixedly arranged on the pattern supporting plates 2 located on the turntable 11.

As shown in FIG. 3 turntable 11 has been rotated so that a flask 22 and pattern supporting are moved to the area B pattern supporting plate. At this time, the sand adding box 23 is descending to join with the flask 22 while the sand in the sand storage barrel 35 begins falling into the sand feeding channel 32, which is subsequently moved toward the flask 22. As sand feeding channel 32 moves toward the flask 22, the movable plate 33 located at the bottom of the sand feeding channel 32 starts to open gradually to permit the sand to fall into the flask 22 and the sand adding box 23. As soon as both flask 22 and sand adding box 23 are filled with sand, the sand feeding channel 32 will automatically reverse the course of its movement to return to its original position, thereby brining about the stoppage of the sand feeding operation. The sustaining shaft 4 located under the pattern supporting plate 2 in the B area raises the fully loaded flask 22 and the sand adding box 23 while the upper press plate 31 keeps pressing the sand in the flask 22 so that the sand in the flask 22 densely encloses the mold pattern 21 and the pouring spout 21'. Both sand storage barrel 35 and sand stopping plate 34 can be coordinated to move up or down in accordance with the size of the flask and with the specification of the cast piece.

Figure 4:
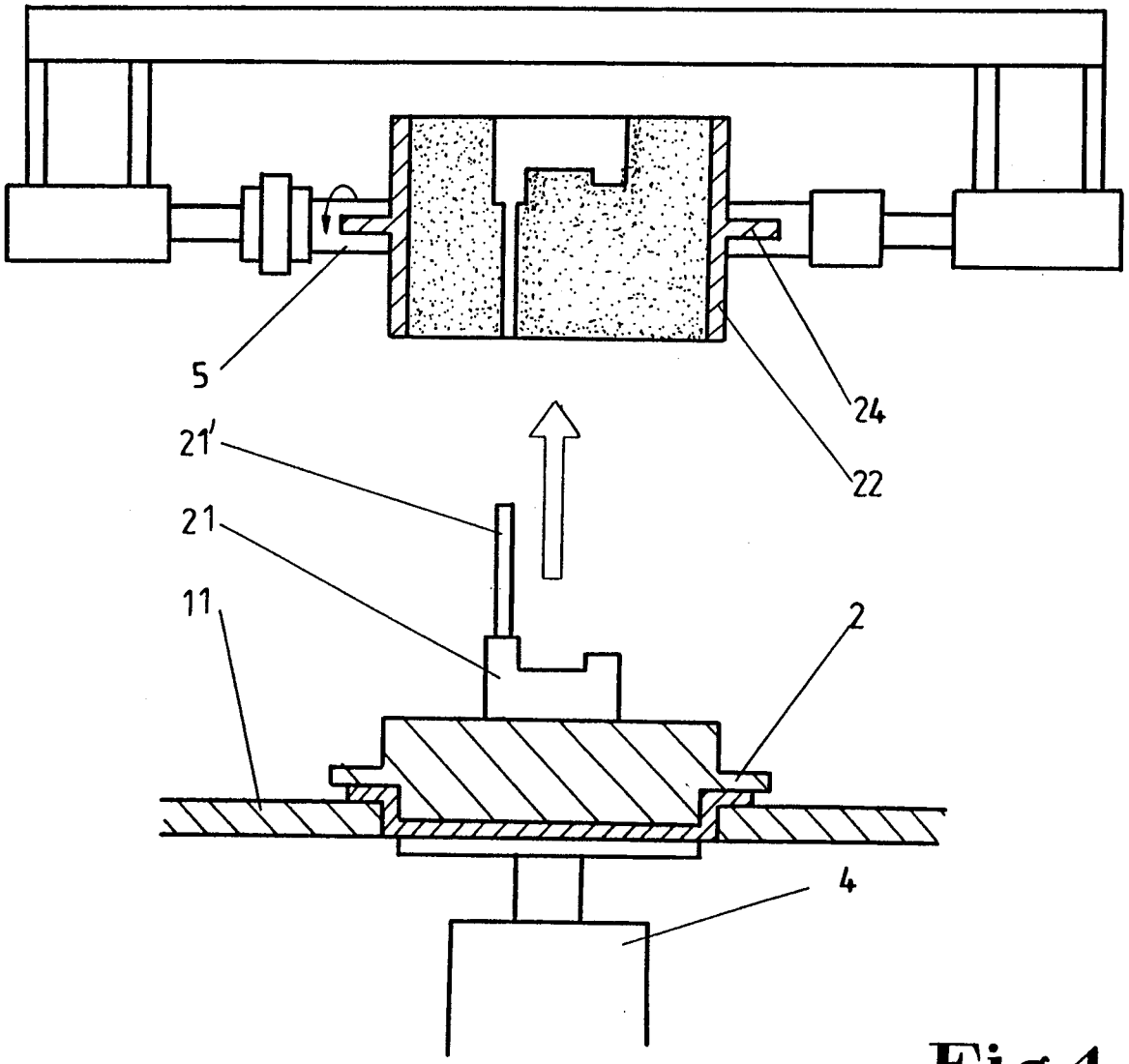
FIG. 4 shows a schematic view of a filled flask according to the present invention being lifted and flipped to form a mold cavity.
Figure 5:
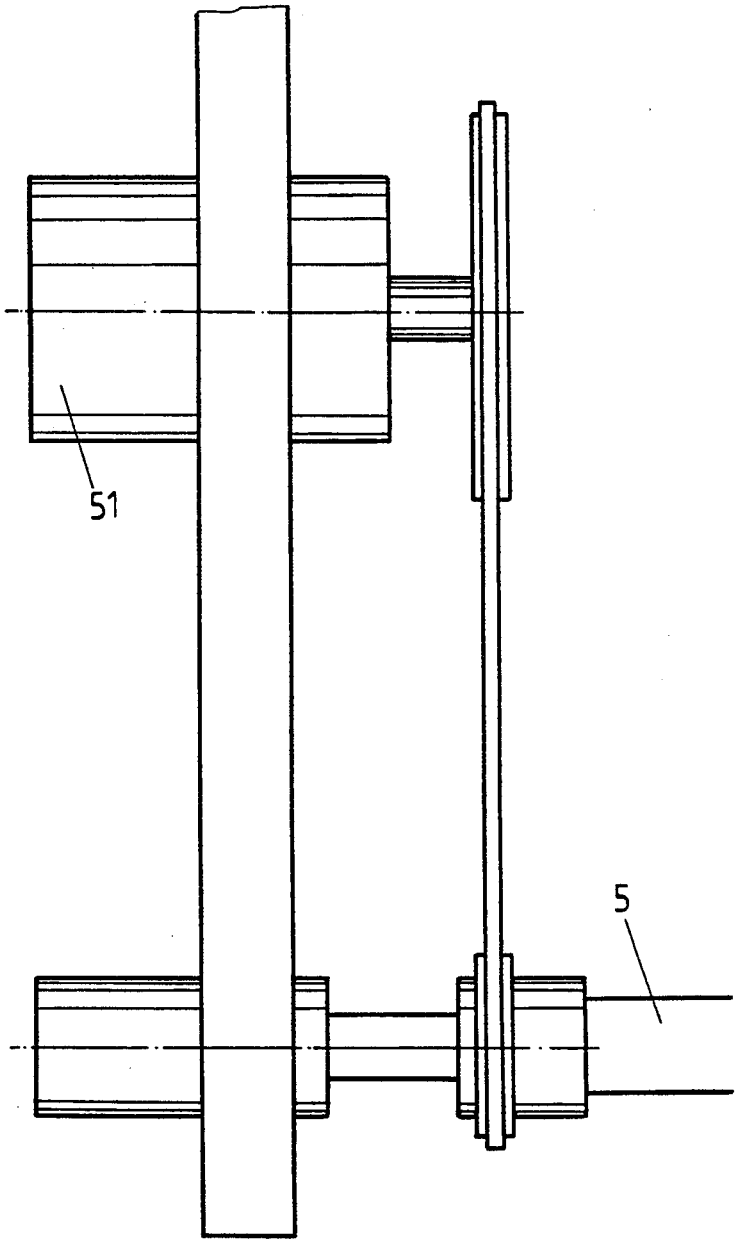
FIG. 5 shows a detailed view of a motor actuated clamp seat according to the present invention.

Now referring to FIGS. 4 and 5, the sand adding box 23 is shown stopping at the position located under the adjusting plate 3 when the operation of feeding and pressing the sand in the flask has been brought to a completion. In the meantime, the turntable 11 rotates to bring the flask area C 22 to (not shown) opposite area C', where another sustaining shaft 4 pushes the sand plate 2 and the fully loaded flask 22 up to the extent that handles 24 extending from said walls of the flask 22 are caught securely by the clamp seat 5. The pattern supporting plate 2 descends by virtue of the action of the sustaining shaft 4, thereby bringing about the separation of the mold pattern 21 from the flask 22. As a result, a mold cavity is formed, and subsequently the clamp seat 5 is actuated by the motor 51 to turn the flask 22 for an angle of 180 degrees so as to make the mold cavity so made to face upwardly to facilitate the removal of the flask 22. Accordingly, an automated process of making a sand casting mold of high quality is thus completed.

In short, the automatic molding apparatus for a sand casting mold cavity embodied in the present invention m comprises a turntable, oil-pressured sustaining devices, and an automated sand feeding means. The present invention has overcome the shortcomings of the conventional sand casting mold of the prior art. In other words, the present invention has successfully simplified and streamlined the process of making a sand casting mold cavity, thereby resulting in a substantial improvement in the quality of mold cavity produced and in a great deal of reduction in the cost of producing a mold cavity.

What I claim is:

1. An automatic molding apparatus comprising:

means for forming sand casting molds, said means comprising a pattern supporting plate, a mold pattern located on said pattern supporting plate, a flask surrounding said pattern supporting plate, said flask having an open top and bottom and handles mounted on an exterior thereof;

a rotatable turntable having said means for forming sand casting molds mounted thereon, said turntable being rotatable to six consecutive positions with respect to a stationary base beneath said turntable means for positioning pouring spouts over a mold pattern in a flask located at first and fourth positions;

means for adding and compressing sand in a flask located at second and fifth positions, said means comprising sand supply means positioned above said turntable, means for opening and closing said sand supply means, a feeding channel beneath said sand supply means, said feeding channel including an upper opening for allowing sand from said sand supply means to enter said feeding channel, said feeding channel including a movable plate which, when open, allows sand in said feeding channel to enter a flask when one of said flasks is positioned below said feeding channel, a pressing plate located above said turntable for compressing sand around said mold pattern in said flask, a sand adding box positioned below said pressing plate and having an open top and bottom for receiving sand from said feeding channel and allowing sand to pass into said flask, said sand adding box having sidewalls in direct communication with sidewalls of said flask to prevent sand from being displaced outside said flask before sand is compressed therein, sustaining shafts arranged under said turntable for raising said flask and said sand adding box into communication with said pressing plate when said flask and sand adding box are filled with sand; and means for separating a flask from a mold pattern to form a mold cavity located at third and sixth positions said means comprising a sustaining shaft arranged under said turntable for pushing said pattern supporting plate and said flask containing compressed sand into communication with clamping means positioned above said turntable for engaging said handles on said flask and for maintaining said flask containing compressed sand in a raised position after said pattern supporting plate and said mold pattern have been lowered by said sustaining shaft to separate said flask from said mold pattern and to thereby form a mold cavity.

2. An automatic molding apparatus according to claim 1, wherein said clamping means includes means for turning over said flask.

* * * * *